US008324591B2

(12) United States Patent
Choi

(10) Patent No.: US 8,324,591 B2
(45) Date of Patent: Dec. 4, 2012

(54) METHOD FOR GENERATING A PULSED FLUX OF ENERGETIC PARTICLES, AND A PARTICLE SOURCE OPERATING ACCORDINGLY

(75) Inventor: Peter Choi, Orsay (FR)

(73) Assignee: Sage Innovations Inc., Waterfront, Port Louis (MU)

( * ) Notice: Subject to any disclaimer, the term of this patent is extended or adjusted under 35 U.S.C. 154(b) by 227 days.

(21) Appl. No.: 12/375,249

(22) PCT Filed: Jul. 25, 2007

(86) PCT No.: PCT/EP2007/057688

§ 371 (c)(1),
(2), (4) Date: Jan. 27, 2009

(87) PCT Pub. No.: WO2008/012335

PCT Pub. Date: Jan. 31, 2008

(65) Prior Publication Data

US 2009/0250623 A1 Oct. 8, 2009

(30) Foreign Application Priority Data

Jul. 28, 2006 (EP) ..... 06291227

(51) Int. Cl.
*G21K 5/00* (2006.01)

(52) U.S. Cl. ..... 250/423 R; 250/424; 315/111.01; 315/111.21; 315/111.31; 315/111.81; 313/231.01; 313/231.31

(58) Field of Classification Search ..... 250/423 R, 250/424, 427, 426, 423 P, 423 F; 315/111.01, 315/111.11, 111.21, 111.31, 111.41, 111.71, 315/111.81; 313/231.01, 231.31
See application file for complete search history.

(56) References Cited

U.S. PATENT DOCUMENTS

| | | | | |
|---|---|---|---|---|
| 3,401,264 | A * | 9/1968 | Carr | 376/111 |
| 3,740,554 | A * | 6/1973 | Morgan, Jr. | 250/423 R |
| 6,435,131 | B1 * | 8/2002 | Koizumi | 118/723 ME |
| 2003/0141831 | A1 * | 7/2003 | Chen | 315/500 |
| 2006/0113498 | A1 * | 6/2006 | Vaudrevange et al. | 250/504 R |

* cited by examiner

*Primary Examiner* — David A Vanore
*Assistant Examiner* — Nicole Ippolito
(74) *Attorney, Agent, or Firm* — Pauley Petersen & Erickson

(57) ABSTRACT

A method for generating a pulsed flux of energetic particles comprises the following steps: —initiating an ion plasma at a first electrode (111) in a vacuum chamber (110) and allowing said plasma to develop towards a second electrode (112) in said vacuum chamber, —at a time at which said ion plasma is in a transitional state with a space distribution of ions or electrons at a distance from said second electrode, applying between said electrodes a short high voltage pulse so as to accelerate said distributed ions or electrons towards said second electrode, whereby a high-energy flux of charged particles is generated while overcoming the space charge current limit of a conventional vacuum diode, and —generating said energetic particles at said second electrode (112). A particle source is also disclosed. Application in particular to ultra-short pulse neutron generation.

12 Claims, 2 Drawing Sheets

METHOD FOR GENERATING A PULSED FLUX OF ENERGETIC PARTICLES, AND A PARTICLE SOURCE OPERATING ACCORDINGLY

FIELD OF THE INVENTION

The present invention relates to a method for producing a flux of energetic particles, and a source of energetic particles to be operated according to such method.

The energetic particles can be e.g. neutrons, ions, electrons, x-rays photons, or other types of energetic particles.

BACKGROUND OF THE INVENTION

Such sources, e.g. sources of neutrons, are already known in the art, and a particular known type of neutron source is referred to as a "neutron tube".

In this type of source, a source of ions is accelerated to a high energy to strike a target. Typically a Penning ion source is used. The target is a deuterium D or tritium T chemical embedded in a metal substrate, typically molybdenum or tungsten. The ions are accelerated to ca. 100 kV to impact onto the target, producing neutrons through the D-D or D-T reaction.

The D-T reaction produces 14.1 MeV neutrons.

The D-D reaction produces 2.45 MeV neutrons but with a cross-section around a hundred times lower than those generated by D-T reaction, i.e. a much lower flux of neutrons.

Therefore it is generally preferred to use a tritium-based target in order to obtain a high neutron flux.

The neutron yield is determined by the energy and current of the beam of accelerated ions, the amount of deuterium or tritium embedded inside the target, and the power dissipation on the target.

A limitation of such neutron tube is that the neutron production rate is generally limited to 10E4 to 10E5 neutrons from a D-T reaction in a 10 microsecond pulse.

The deuteron beam current ID of such source is generally in the order of less than 10 mA.

Moreover, access to tritium is highly restricted for security reasons, which is of course a problem for the commercial use of such source.

Furthermore, the tritium materials used in such source are radioactive, and thus require very specific security means.

In addition, such sources are also limited with respect to the duration of their pulses.

Indeed, for some applications it would be desirable to obtain ultra short pulses (i.e. pulses in the order of a few nanoseconds only)—and with sources as mentioned above it is generally not possible to obtain significant flux of particles in such an ultra short pulse.

It is known to generate such short pulses of neutrons using an accelerator. A system based on the D-Be reaction has been proposed. Deuterons from an ion source injector are accelerated in a cyclotron to 9 MeV and then directed onto a Be target to produce neutrons. Such system is however low current, large and complex.

It thus appears that the existing sources for producing pulsed beams (or more generally fluxes) of particles are associated to some limitations.

Moreover, the existing sources are exposed to an additional important limitation.

Indeed, the sources which operate on the basis of a pulsed voltage between two electrodes, in order to accelerate charged particles between the two electrodes, are exposed to a severe limitation imposed by the Child-Langmuir law.

This law limits the flux of charged particles between the electrodes, as a consequence of the accumulation of these charged particles between the electrodes.

This phenomenon is generally referred to as a "space charge" phenomenon. It constitutes a barrier which limits the operations of the existing sources.

SUMMARY OF THE INVENTION

An object of the present invention is to provide a method for generating a pulsed flux of energetic particles (e.g. neutrons, ions, electrons, x-rays photons, etc.), as well as a source implementing such method, which overcomes the above-mentioned limitations.

More specifically, an object of the invention is to generate a flux of energetic charged particles having a very high current density during an ultra-short pulse.

By "very high current density", it is meant a current density of the order of magnitude of 1 kA/cm$^2$ or more.

The definition of an "ultra-short pulse" is a pulse whose duration is around a few nanoseconds.

A further object of the invention is to generate a flux of particles with a current density which is higher than the limit imposed by the Child-Langmuir law in vacuum.

Still a further object of the invention is to provide an energetic particle source which can be easily fielded, i.e. deployed on various sites, in particular by being reasonably compact and transportable.

Accordingly, the invention provides according to a first aspect a method for generating a pulsed flux of energetic particles, comprising the following steps:

- initiating an ion plasma at a first electrode in a vacuum chamber and allowing said plasma to develop towards a second electrode in said vacuum chamber,
- at a time at which said ion plasma is in a transitional state with a space distribution of ions or electrons at a distance from said second electrode, applying between said electrodes a short high voltage pulse so as to accelerate said distributed ions or electrons towards said second electrode, whereby a high-energy flux of charged particles is generated while overcoming the space charge current limit of a conventional vacuum diode, and
- generating said energetic particles at said second electrode.

According to a second aspect, the present invention provides a source of energetic particles, comprising:

- a vacuum chamber containing a first electrode and a second electrode, said first electrode forming a plasma ion source capable of causing a ion plasma to be generated and to develop in said chamber towards said second electrode,
- a ion source driver connected to said first electrode for energizing said plasma ion source,
- a high-voltage generator connected between said first and second electrodes, and
- a control and monitor unit for causing the application of a short high voltage pulse between said first and second electrodes at a time at which said ion plasma is in a transitional state in response to the activation of said plasma ion source by said ion source driver, with a space distribution of ions or electrons at a distance from said second electrode, so as to accelerate said distributed ions or electrons towards said second electrode and generate a high-energy flux of charged particles while overcoming the space charge current limit of a conventional vacuum diode.

Preferred but non-limiting aspects of the present invention are as follows:

said energetic particles are generated by a beam/target nuclear or electromagnetic reaction between said accelerated ions or electrons and said second electrode.

said second electrode is a semi-transparent grid structure, and said energetic particles are constituted by the plasma ions or electrons themselves travelling through said second electrode.

said predetermined time is a time delay from the start of plasma generation, said delay being determined from at least the voltage level of the pulse, the geometry of the electrodes and their mutual distance and chamber pressure.

said first electrode comprises a pair of electrodes members forming a plasma discharge ion source.

BRIEF DESCRIPTION OF THE DRAWINGS

Other aspects, aims and advantages of the invention will appear more clearly the following description of preferred, but non-limitative embodiments thereof, made in reference to the drawings, in which.

DETAILED DESCRIPTION OF PREFERRED EMBODIMENTS

Figure 1:
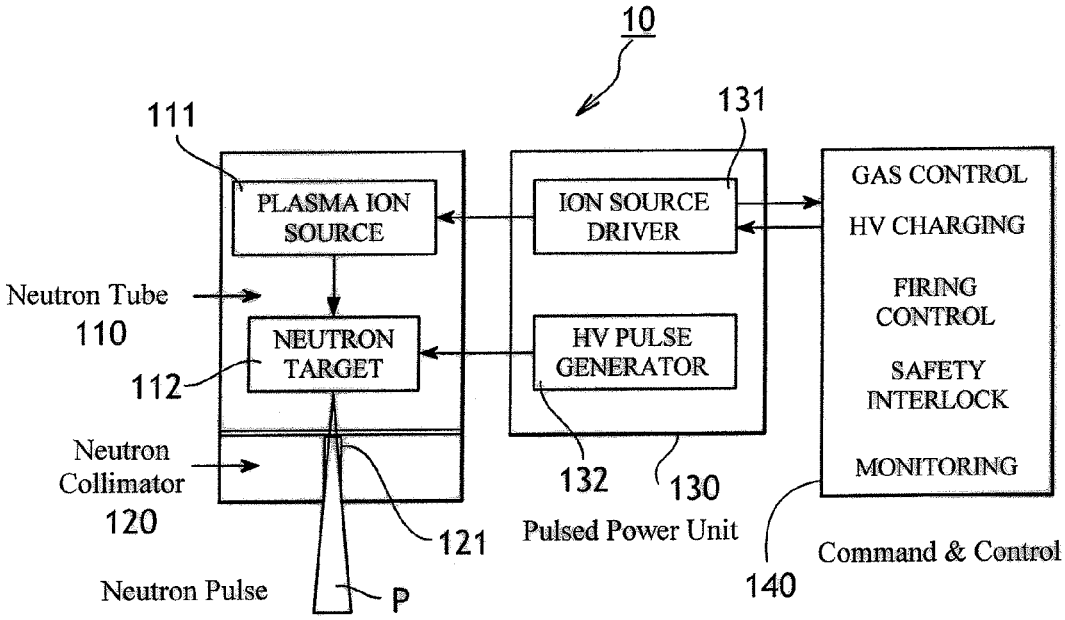
FIG. 1 is a diagrammatic representation of a particle source according to the present invention.

Now referring to the drawings, FIG. 1 diagrammatically shows a source 10 of particles P according to the present invention.

Figure 3A:
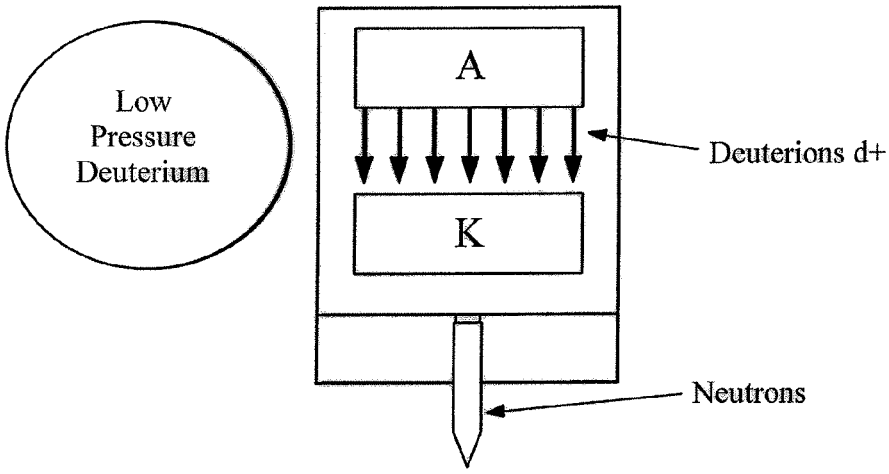
Figure 3B:
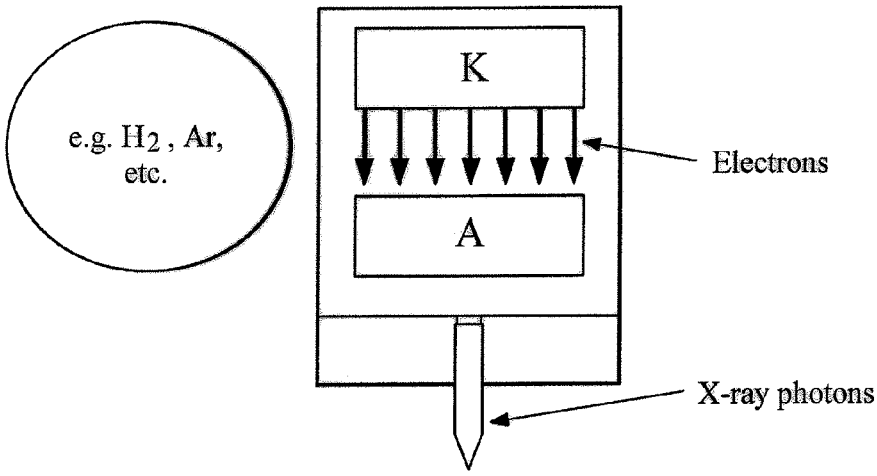
Figure 3C:
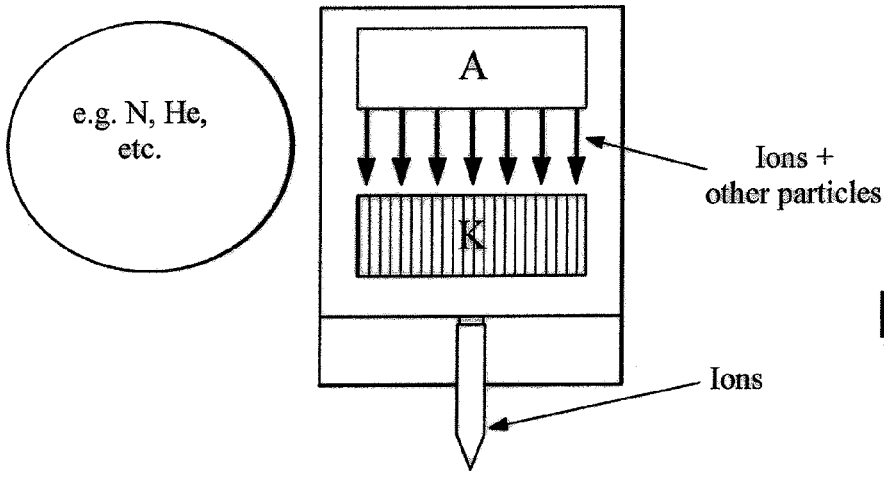

Such particles can be of different types, and some specific examples will be mentioned when referring to FIGS. 3*a* to 3*c*.

The specific example of a source of neutrons will now be described with reference to FIG. 1.

General Description of the Source

The source 10 as shown in FIG. 1 comprises the following main parts:

A neutron tube 110 comprising a chamber filled with low pressure gas (by low pressure it is meant here a near-vacuum atmosphere typically in the range of 1-10 Pa) and containing:

a first electrode 111 for generating a plasma and forming a plasma ion source; this first electrode 111 will also be referred to as the "emitting" electrode, a second electrode 112 which forms a target which, when impacted by charged particles from the plasma generated by the first electrode 111, generates energetic particles P from said impacts, the first and second electrodes respectively corresponding to an anode and to a cathode, or conversely-depending on the application of the source, A neutron collimator 120 arranged downstream of the neutron tube for receiving the energetic particles P generated by the target electrode 112 through a window 121 and for collimating the flux of energetic particles into a beam of said particles P, A pulsed power unit 130 which mainly comprises:

an ion source driver 131 connected to the emitting electrode 111 for powering said electrode and allow the initiation of a plasma in the chamber of neutron tube 110, a generator 132 of high voltage (HV) electrical pulses connected to electrodes 111, 112 for establishing a pulsed high voltage (typically 500 kV or more for a neutron source) therebetween, with the first or second electrode 111 or 112 being kept at a constant voltage (typically grounded) while the other is subjected to high potential; these high voltage pulses are generated synchronously with the initiation of the plasma;

A control and monitoring unit 140 which is connected to the pulsed power unit 130 and to the neutron tube 110 for controlling the various parameters of the source—and in particular the following parameters:

gas control (i.e. control of the composition and pressure of the atmosphere in the neutron tube chamber 110), high voltage charging (i.e. control of the voltage pulses to be delivered by the HV pulse generator 132), control of the HV pulse firing at generator 132 and of the powering of the first electrode 111 by the ion source driver), which further ensures a "safety interlock", i.e. prevents generating the HV pulse unless a suitable plasma has first been established by the ion source at the first electrode 111, and which monitors operation.

It should be noted here that the first electrode 111 can have different embodiments. In a first of such embodiments, it comprises a set of two electrode members powered by the current received from the ion source driver. In a second embodiment, the plasma is initiated by a laser beam directed onto the first electrode 111. Of course, other embodiments are possible.

Principle of Operation

The operation of the source 10 exploits a transition period which immediately follows the initiation of a ion plasma at the first electrode 111.

In the illustrated embodiment, a plasma (i.e. a reservoir of positive and negative electrical charges) is initiated by the powering of the first electrode 111, the plasma being progressively developed from said first electrode 111.

The plasma then expands from the first electrode 111, with a plasma temperature of less than 1 eV (1 eV=116° K.) and an expansion velocity typically less than 1 cm/microsecond.

The "transition period" referred to above corresponds to the time period between the initiation of the plasma and the time where the said plasma diffuses within the chamber 110 and reaches the second electrode 112 according to the plasma initiation and expansion as mentioned above.

At this point, the space between the two electrodes has a high density of charges (ions and electrons) in the vicinity of the emitting electrode 111, and a much lower density of charges in the vicinity of the other electrode 112. This condition is due to the finite expansion velocity of the plasma created at the emitting electrode 111 and the velocity distribution of the plasma ions and electrons.

Figures 2A, 2B:
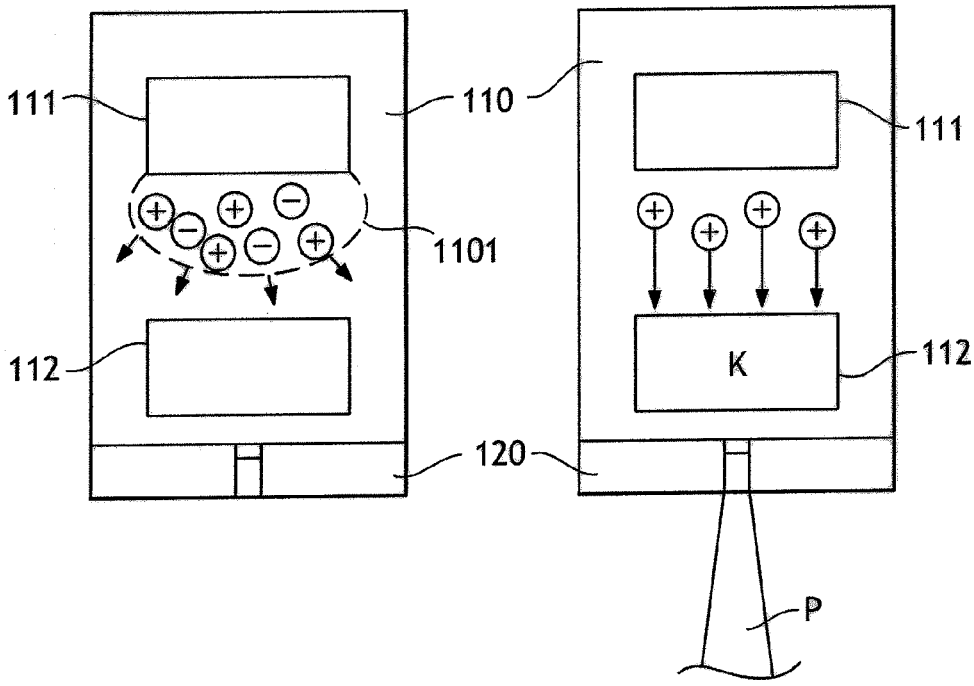
FIGS. 2*a* to 2*b* illustrate the basic principle of particle generation according to the present invention, FIGS. 3*a* to 3*c* diagrammatically illustrate three embodiments, which correspond respectively to the generation of three particle types.

As illustrated in FIG. 2*a*, during the transition period, a plasma edge 1101 corresponding to the plasma envelope develops from the emitting electrode 111 and progresses towards the second electrode 112. The positively and negatively charged particles contained in the plasma are represented in FIG. 2*a* "+" or "−" symbols.

The transition period of the plasma is used for synchronizing the supply of the HV pulse to the target electrode 112. More particularly, a pulsed high voltage is applied between electrodes 111 and 112 at a predetermined time during the transition period, as will be explained later.

The time of triggering the high voltage is monitored by the control and monitor unit 140, on the basis of the initiation time of the plasma.

It should be observed here that triggering the HV pulse during the transition period causes an acceleration of the initial beam of charges from the emitting electrode 111 towards the target electrode 112, as illustrated in FIG. 2*b*. For this reason, the HV pulse may be referred to in the rest of the description as an "acceleration pulse".

The charges which are accelerated to form this initial beam are the "target charges", i.e. the charges of the initial plasma whose polarity is opposed to the polarity of the target electrode when the latter is powered by the HV pulse. They can be ions or electrons.

These accelerated charges then impact on the target electrode 112, which in turns produces a beam of energetic particles P.

This production of energetic particles can be obtained through a variety of processes, as illustrated in FIGS. 3*a*-3*c*, and more particularly:

- through a beam target nuclear or electromagnetic reaction, as illustrated in FIGS. 3*a* and 3*b*, or
- by extracting a flux of ions passing through a grid structure, as illustrated in FIG. 3*c*.

It has been indicated in the foregoing that the plasma initiation and the acceleration pulse triggering are synchronized. This is performed by the acceleration pulse following the plasma initiation by a predetermined delay whose value depends inter alia on the voltage level applied to the first electrode 111, the geometry of the electrodes 111 and 112 (these electrodes forming a diode whose behavior depends on said geometry), the voltage level applied across the electrodes 111 and 112, and the pressure in the chamber.

This delay is set so that a proper condition of the charge density distribution in the space between the emitting electrode 111 and the target electrode 112 is obtained prior to the application of the HV pulse generating the target charge acceleration.

Said proper condition is when a significant density of charges having a polarity opposed to the polarity of the target electrode is already developed, but the front 1101 is still at a distance from the target electrode.

The plasma which develops during the transition period between the emitting electrode 111 and the target electrode 112 plays an important role in overcoming the space charge limitation mentioned in introduction of this specification, i.e. the Child-Langmuir law which dictates a space charge limited current flow.

Indeed, the space charge phenomenon limits the current in a vacuum diode to a maximum value that depends only on the diode geometry and the voltage, and this in turn limits the maximum current that can flow in a vacuum tube operating at moderate power.

The current density is expressed as $J \propto V^{3/2}/d^2$, where V is the voltage across the diode and d the distance between the anode and cathode, in a 1-D planar description.

At high pulsed power, when an impulse voltage is applied across the diode, the current usually rises during the voltage pulse, while the voltage V measured across the diode simultaneously falls at the same time, as dictated by the diode impedance Z=V/I of the driving circuit which is continuously decreasing. At a sufficiently high current level, the voltage across the diode falls to practically zero and the diode has effectively become a short circuit (i.e. the impedance has collapsed).

Such impedance collapse, or closure of the diode, derives from the development of a fully conducting plasma across the anode and cathode of the diode, which takes a finite time, defined as the transition period, as mentioned in the foregoing.

By triggering the HV pulse before the end of this transition period, the target charges can be accelerated through the developing plasma, the obstacle of the decreasing voltage due to impedance collapse being avoided.

In this respect, the plasma plays the role of a retaining barrier against diffusion of the charges it contains.

On the other hand, the presence of a dilute plasma (i.e. the plasma in progression but not yet fully conducting) in the diode region is sufficient to provide charge neutralization to the accelerating beam and to prevent the formation of a space charge, which would otherwise occur if the beam of charged particles were to be accelerated through a vacuum region. This neutralization allows to obtain a beam current far exceeding the limit set by the Child-Langmuir law.

The synchronization and delay between the initial electrode discharge and the accelerating pulse thus allows sufficient plasma density to be developed in the diode region, in order to provide charge neutralization to the accelerated beam of charged particles.

It has been seen that the time of triggering of the accelerating pulse was determined with respect to the time of initiation of a plasma created by the first pulse discharge.

The duration of the accelerating pulse is also a time parameter of the source operation, and is limited by the diode closure time.

In a conventional particle source of vacuum diode type, the control device of the source avoids all possibilities that could lead to an impedance collapse, and the diode is operated at moderate to high vacuum (less than 0.1 Pa).

More specifically, in a conventional neutron tube, where a beam of deuterons is accelerated across a diode to strike a target to produce neutrons, the current drawn in the diode is then limited by space charge current flow restriction to typically 0.3 $A/cm^2$ for a deuteron beam with an accelerating voltage of 100 kV across a diode gap of 2 cm. In practice, the beam current used is much below this value, typically less than 1 mA. This limits the fluence of neutron produced in such devices (example of a Thermo Electron, Corp. Model P325 neutron generator, with 100 kV accelerating voltage, maximum beam current of 0.1 mA, neutron yield of $3\times10^8$ n/s and minimum pulse width of 2.5 μs.)

In the present invention, the diode operates in a low dynamic pressure range, typically from 0.1 to 10 Pa.

The diode is operated with the plasma initiated at the emitting electrode, and a space charge neutralized beam of a few kA can be accelerated across the diode gap, with a 500 kV accelerating voltage and 1 cm diode gap.

The duration of the beam (i.e. of the accelerating voltage) is typically around 10 ns.

In the case of the present invention, substantially higher equivalent fluence rate can be obtained in a single pulse (108 n per pulse of 10 ns produces an equivalent fluence rate of 1016 n/s). It will be appreciated here that the principle of operation of the source, where a high-energy flux of charged particles is produced by the direct application of a ultra-short high voltage pulse to electrodes between which an ion plasma is in a transitional state, allows to overcome the space charge current limit of a conventional vacuum diode. For instance, a short pulse (<10 ns), high current (>kA), high-energy (>700 keV) charged particle beam can be generated.

Additional Description of a Preferred Embodiment

As mentioned above, a source according to a particular embodiment of the present invention is used for generating an initial beam of deuterons, which hit a cathode target 112 in order to produce a beam of neutrons.

In this case, the low pressure atmosphere of the chamber is made (at least in majority) with deuterium.

In order to be able to use the source in a public environment, it is desirable to avoid any use of radioactive materials in particular for the target electrode.

With that concern in mind, natural lithium can be selected as the target material, a broad spectrum of high energy neutrons with maximum energy extending up to 14 MeV being produced through the 7Li(d,n)8Be reaction.

The use of 7Li as the target material requires deuteron with significantly higher energy (typically above 500 keV) than the one that would be required if a tritium target were used (the latter requiring an energy around 120 keV only), so that higher acceleration will be necessary in such embodiment.

In addition, due to the fact that pure Li is a metal with a low melting point and can be easily oxidized, it may be preferred to use a compound bearing 7Li.

In the particular embodiment illustrated here, the high-energy deuteron is produced by the direct application of a short high voltage pulse across a plasma ion diode.

This approach overcomes the space charge current limit of a vacuum diode and allows a short pulse (<10 ns), high current (>kA), high-energy (>500 keV) deuteron beam to be generated.

The impact of such an energetic deuteron beam on the lithium bearing target results in a neutron pulse with high intensity and energy.

The neutron pulse is generated "on demand" upon a command trigger. At all other times, the whole system is in an "off" condition. Thus no accidental neutron generation of is possible.

The HV pulse generator 132 preferably comprises a sequence of voltage multiplication and pulse compression modules. From a starting voltage supply of (e.g. 220 V), the voltage is first increased to 30 kV using a conventional electronic inverter unit. This voltage is used to feed a four-stage Marx circuit.

Upon a command trigger from the unit 140, the Marx circuit erects a pulse voltage of 120 kV. This voltage is then used to charge a pulse forming line circuit to produce a 5 ns pulse of 120 kV.

The output of this pulse forming circuit is coupled to a 6× pulse transformer, providing a maximum final voltage pulse of 720 kV. This high voltage pulse is then fed through a special insulated high voltage coupling stage to the neutron target holder.

The high voltage generator is immersed in high voltage insulating oil, which allows a very compact unit to be designed.

The ion source 111, which generates the deuterons, is provided by a separate discharge in deuterium. A separate high voltage ion source driver 131 is used to power the ion source is response to a control signal with which the high voltage pulse generator is synchronized.

The ion source is arranged as the anode 111 of a plasma diode, with the lithium bearing neutron target being the cathode 112. Upon application of the high voltage pulse, a deuteron beam with a current >1 kA can then be accelerated by the high voltage to impact onto the cathode target, thereby generating the high energy neutrons.

The operation of the whole generator is under the control of a dedicated console which is part of the control and monitor unit 140 and which provides control and status information on all modules of the neutron generator. Unit 140 is also coupled to a set of safety sensors to ensure safety interlock and proper operation of the neutron generator system.

The neutron tube chamber 110 is evacuated by a small turbo molecular pump to normally less than 0.1 Pa. Upon the command for generating a neutron pulse, deuterium gas is injected into the chamber through the discharge electrodes of the ion source, raising the chamber pressure to about 10 Pa. The ion source driver is then energized to produce the first transient plasma. After a predetermined time delay (which corresponds to the time between the creation of the transient plasma and the expansion of said plasma sufficiently to provide charge neutralization), the control and monitoring unit 140 checks that the ion source is correctly operating and then issues a command to initiate the high voltage pulse generator, where upon an energetic deuteron beam will be created to impinge on the neutron target, and an ultrashort pulse of neutron will be generated.

At the end of the pulse, the chamber is again evacuated to below 0.1 Pa, ready for the next pulse.

The neutrons are generally emitted isotropically. In order to produce a specific beam for localized analysis or "interrogation" of an object, a neutron collimator based on a hydrogen-rich substance, e.g. $CH_2$, is used to define the beam aperture in a forward direction. The collimator effectively moderates and thermalizes the neutrons. The thermal neutrons arrive at the object under interrogation much later than the original pulse and provide an additional channel of information.

Extensive numerical modeling, using the 3-D Monte-Carlo code MCNP4B, has established for near field objects of <1 m a fluence of $10^4$ neutrons./cm$^2$ for a good signal to noise ratio in a prototype according to the invention.

This figure does not take into consideration possible improvement in detector performance using advanced signal processing algorithm. If the target surface is 1 m away from the neutron source, then the neutron source strength must be $4\pi\times10^8$ neutrons total, assuming isotropic emission.

The prototype illustrated is capable of producing a 5 ns pulse of $10^9$ neutrons through the 7Li(d,n)8Be reaction.

$$7\mathrm{Li}+d\rightarrow 8\mathrm{Be}+n+15.02\ \mathrm{MeV}$$

This reaction is exothermic and the residual nucleus may be left in many different excited states, even for not very high deuteron energy. The neutrons thus produced have a broad energy range, with energy extending up to 14 MeV.

In order to address the reproducibility of the neutron energy spectrum, the neutron source strength is controlled by both:

the operating voltage of the Marx unit, and thus the magnitude of the acceleration pulse, and the impedance of the driver, these two parameters controlling together the ion beam current.

The generation of $10^9$ neutrons in a 5 ns pulse represents very high neutron rate of $2\times10^{17}$ neutrons per second. However, as the generator is designed to operate at a repetition rate of around 1 Hz, the duty cycle is very low and the average neutron source rate is only $10^9$ neutrons per second. This is important for personnel safety consideration for public operations.

Examples of Specific Embodiments

A source as described above can be used for generating different kinds of energetic particles.

If the emitting electrode is defined as the anode (by the sign of the accelerating pulse) and the low pressure gas is e.g. deuterium, then the cathode acts as a target and the source can be used as a source of neutrons (cf. FIG. 3*a*).

If the emitting electrode is the cathode and the low pressure gas is e.g. $H_2$ or Ar, the anode acts as a target and the source can be used as a source of X-ray photons (cf. FIG. 3*b*).

The source can also be used as an ion beam source—e.g. with the emitting electrode being the anode and the cathode being arranged as a semi transparent grid structure through which the accelerated beam of positive ions can travel (cf. FIG. 3*c*).

The ion flux is extracted after passing through such cathode.

Similarly, the source can also be used as an electron beam or negative ion source—e.g. with the emitting electrode being the cathode and the anode being arranged as a grid through which the accelerated beam of negatively charged particles can travel.

The invention claimed is:

1. A method for generating a pulsed flux of energetic particles, comprising the following steps:

initiating a plasma comprising ions and electrons at a first electrode in a vacuum chamber and allowing said plasma to develop from the first electrode towards a second electrode in said vacuum chamber during a transition period, wherein said transition period corresponds to a time period between an initiation of the plasma by powering of the first electrode and a time where the plasma has reached the second electrode, and before the end of the transition period, at a predetermine time when the plasma is dilute in the vacuum chamber, applying between said first electrode and said second electrode a short high voltage pulse to accelerate said ions or said electrons towards said second electrode to generate said pulsed flux of energetic particles at said second electrode while overcoming the space charge current limit of a conventional vacuum diode.

2. A method according to claim 1, wherein said energetic particles are generated by a beam/target nuclear or electromagnetic reaction between said accelerated ions or electrons and said second electrode.

3. A method according to claim 1, wherein said second electrode is a semi-transparent grid structure, and said energetic particles are constituted by the plasma ions or electrons themselves travelling through said second electrode.

4. A method according to claim 1, wherein the time when the short high voltage pulse is applied during the transition period is determined from at least the voltage level of the short high voltage pulse, the geometry of the first electrode and the second electrode and their mutual distance and vacuum chamber pressure.

5. A method according to claim 1, wherein said first electrode comprises a pair of electrodes members forming a plasma discharge ion source.

6. A source of energetic particles, comprising:

a vacuum chamber containing a first electrode and a second electrode, said first electrode forming a plasma source capable of causing a plasma comprising ions and electrons to be generated and to develop in said chamber towards said second electrode, an ion source driver connected to said first electrode for energizing said plasma source, a high-voltage generator connected between said first and second electrodes, and a control and monitor unit for causing the application of a short high voltage pulse between said first and second electrodes during a transition period, said transition period corresponding to a time period between an initiation of the plasma by powering of the first electrode and a time where the said plasma diffuses within the vacuum chamber and reaches the second electrode, in response to the activation of said plasma source by said ion source driver, to accelerate said ions or said electrons within said plasma at a predetermined time when the plasma is dilute in the vacuum chamber towards said second electrode and generate a flux of energetic particles while overcoming the space charge current limit of a conventional vacuum diode.

7. A source according to claim 6, wherein said energetic particles are generated by a beam/target nuclear or electromagnetic reaction between said accelerated ions or electrons and said second electrode.

8. A source according to claim 6, wherein said second electrode is a semi-transparent grid structure, and said energetic particles are constituted by the plasma ions or electrons themselves travelling through said second electrode.

9. A source according to claim 6, wherein said control and monitor unit is capable of firing said high voltage pulse after a predetermined time delay from the start of the plasma generation.

10. A source according to claim 9, wherein said predetermined time delay is determined from at least the voltage level of the short high voltage pulse, the geometry of the first electrode and the second electrode and their mutual distance and vacuum chamber pressure.

11. A source according to claim 6, wherein said first electrode comprises a pair of electrodes members forming a plasma discharge ion source.

12. A method for generating a pulsed flux of energetic particles, comprising the following steps:

initiating a plasma comprising ions and electrons at a first electrode in a vacuum chamber and allowing said plasma to develop from the first electrode towards a second electrode in said vacuum chamber during a transition period, wherein said transition period corresponds to a time period between an initiation of the plasma by powering of the first electrode and a time where the plasma has reached the second electrode, and before the end of the transition period, at a predetermine time when the plasma is dilute in the vacuum chamber, applying between said first electrode and said second electrode a short high voltage pulse to accelerate said ions or said electrons towards said second electrode to generate said pulsed flux of energetic particles at said second electrode while preventing the formation of a space charge.

* * * * *